United States Patent [19]

Billman et al.

[11] Patent Number: 4,946,403

[45] Date of Patent: Aug. 7, 1990

[54] LOW INSERTION FORCE CIRCUIT PANEL SOCKET

[75] Inventors: Timothy B. Billman, King; Robert G. McHugh, Lewisville; Roger L. Thrush, Clemmons, all of N.C.

[73] Assignee: AMP Incorporated, Harrisburgh, Pa.

[21] Appl. No.: 398,795

[22] Filed: Aug. 24, 1989

[51] Int. Cl.[5] ..... H01R 13/62

[52] U.S. Cl. ..... 439/326; 439/631; 439/733

[58] Field of Search ..... 439/325, 326, 327, 328, 439/631, 636, 59, 61, 62, 65, 629, 630, 733

[56] References Cited

U.S. PATENT DOCUMENTS

| | | | |
|---|---|---|---|
| 3,671,917 | 6/1972 | Ammon et al. | 439/636 |
| 3,685,001 | 8/1972 | Krafthefer | 439/636 |
| 3,778,753 | 12/1973 | Occhipinti et al. | 439/631 |
| 3,848,952 | 11/1974 | Tighe, Jr. | 439/326 |
| 4,136,917 | 1/1979 | Then et al. | 439/326 |
| 4,526,433 | 7/1985 | Tanaka | 439/325 X |
| 4,557,548 | 12/1985 | Thrush | 439/842 |
| 4,558,912 | 12/1985 | Coller et al. | 439/246 |
| 4,575,172 | 3/1986 | Walse et al. | 439/326 |
| 4,713,013 | 12/1987 | Regnier et al. | 439/62 |
| 4,722,700 | 2/1988 | Kuhn et al. | 439/629 |
| 4,737,120 | 4/1988 | Grabbe et al. | 439/326 |
| 4,781,612 | 11/1988 | Thrush | 439/328 |
| 4,826,446 | 5/1989 | Juntwait | 439/326 |
| 4,832,617 | 5/1989 | Bropwn | 439/326 |
| 4,850,891 | 7/1989 | Walkup et al. | 439/326 |
| 4,850,892 | 7/1989 | Clayton et al. | 439/326 |

OTHER PUBLICATIONS

Molex-Japan-Representation of Contact Terminal, received by AMP Incorporated, on or before 3-20-89.

*Primary Examiner*—Neil Abrams
*Assistant Examiner*—Khiem Nguyen
*Attorney, Agent, or Firm*—Robert W. Pitts

[57] ABSTRACT

A socket suitable for electrically connecting circuit panels such as single inline memory modules (SIMM) employs a plurality of contacts positioned within cavities in an insulative housing. This socket permits zero force or low force insertion of circuit panels into the socket and is of the type in which the circuit panel is rotated from a first position to a second position where deflection is imparted to the two contact springs. The contact terminals used with this socket are insertable into an insulative housing through the rear of the housing. A cantilever spring extending from the rear of the contact terminal is located on one side of a panel receiving slot and a curved spring is located on the other side of the panel receiving slot. Cantilever arms having terminal securing teeth at their ends engage the insulative housing and one cantilever arm extends between the cantilever spring and the curved spring and engages a central rib located within each cavity and comprising the lower surface of the panel receiving slot.

33 Claims, 10 Drawing Sheets

LOW INSERTION FORCE CIRCUIT PANEL SOCKET

BACKGROUND OF THE INVENTION

1. Field of the Invention

This application relates to an electrical connector and a terminal for use in the electrical connector of the type suitable for use in establishing an interconnector to traces on a circuit panel, especially to a zero or low insertion force electrical connector socket for use in establishing electrical interconnections to a single in-line memory module.

2. Description of the Prior Art

Single in-line memory modules (SIMM) represent a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

One approach for mounting single in-line memory modules on a daughterboard would be to employ plug in leads adjacent one edge of the circuit panel. These plug in leads can then be connected to conventional printed circuit board contacts such as miniature spring contacts.

An alternate approach has been to use single in-line memory module sockets to establish a disconnectable interconnection to traces along the edge of the circuit panel used in the single in-line memory module. Terminals for use in such sockets are disclosed in U.S. Pat. No. 4,557,548 and U.S. Pat. No. 4,558,912. Additional details of an insulative housing which is suitable for use with those terminals is disclosed in U.S. Pat. No. 4,781,612. The socket disclosed in these patents is intended for use with in-line memory modules having a center line spacing for pads or traces at the edge of the circuit panel of 0.100 inch. Since the terminals employed in that socket are stamped and formed, the width of the terminals generally precludes establishing an interconnection on closer center line spacings.

Instead of using stamped and formed terminals, other single in-line memory module sockets employ edge stamped terminals. For example, U.S. Pat. No. 4,737,120 discloses an electrical connector of the type suitable for use in a single in-line memory module in which a zero or low insertion force interconnection is established between the terminals and the pads on the circuit panel. The circuit panel is inserted at a angle and then cammed into position. The insulative housing on the connector provides a stop to hold the circuit panel in position. Other low insertion force connectors are disclosed in U.S. Pat. No. 4,136,917; U.S. Pat. No. 4,575,172; U.S. Pat. No. 4,826,446 and in U.S. Pat. No. 4,832,617. The contact terminals in each of these patents is edge stamped Sockets using terminals of this type are suitable for use on center line spacings on the order of 0.050 inches.

Not all commercially available single in-line memory modules are manufactured in compliance with generally accepted standards for such modules, such as appropriate JEDEC standards. Nonstandard single in-line memory module circuit panels are manufactured with the pad portions of the traces adjacent the edge of the circuit panel being shorter than required by industry acknowledged standards. Deviations in JEDEC standards have also occurred because some module manufacturers have been unable to maintain a tolerance of ±0.003 inches on the module thickness as required by JEDEC. Tolerances of ±0.008 inches are more realistic; but such tolerances complicate the design of the terminal because a larger deflection range is necessary.

U.S. Patent Application 07/360,644 filed June 2, 1989, discloses a full force socket suitable for use with nonstandard circuit panels or single inline memory modules. The instant invention discloses a zero or low insertion force circuit panel socket suitable for use with nonstandard single inline memory modules.

SUMMARY OF THE INVENTION

A socket for establishing an electrical connection with a circuit panel comprises an insulative housing having a plurality of contact terminals located within cavities in the insulative housing. The socket employs contact terminals which can establish electrical connection with pads on one or on both sides of a circuit panel, such as a single inline memory module. Each contact has a first cantilever spring and a second curved spring exposed adjacent the mating face of the housing. The terminals are secured to the housing by barbs or frictional engagement members. The cantilever spring is fixed adjacent the rear edge of the contact terminal and extends toward the mating edge of a contact terminal located adjacent the mating face of the socket. The curved spring has a fixed end located between the rear edge and the mating edge. The curved spring initially extends toward the rear edge of the contact terminal and the rear face of the housing and subsequently toward the mating edge of the terminal and the mating face of the housing. The cantilever spring and the curved spring engage opposite sides of a circuit panel which can be inserted into a panel receiving slot in the insulative housing between the contact points of the curved spring and the cantilever spring and then rotated within the slot to deflect both the cantilever spring and the curved spring.

BRIEF DESCRIPTION OF THE DRAWINGS

FIG. 3 is a front or elevational view of the socket shown in FIG. 1.

FIG. 6 is a view similar to FIG. 5 showing rotation of the circuit panel or single inline memory module into an upright position, at which a stable contact is established by the curved spring and the cantilever spring on opposite sides of the circuit panel.

FIG. 8 is a sectional view taken along sections line 8—8 in FIG. 7 showing a configuration of a terminal for mounting a circuit panel parallel to a printed circuit board.

FIG. 9 is a front view of the socket shown in FIG. 7 showing the panel receiving slot.

FIG. 13 is an alternate embodiment of a socket having the same orientation relative to a printed circuit board as the embodiment of FIGS. 1–6.

DETAILED DESCRIPTION OF THE PREFERRED EMBODIMENTS

Figure 1:
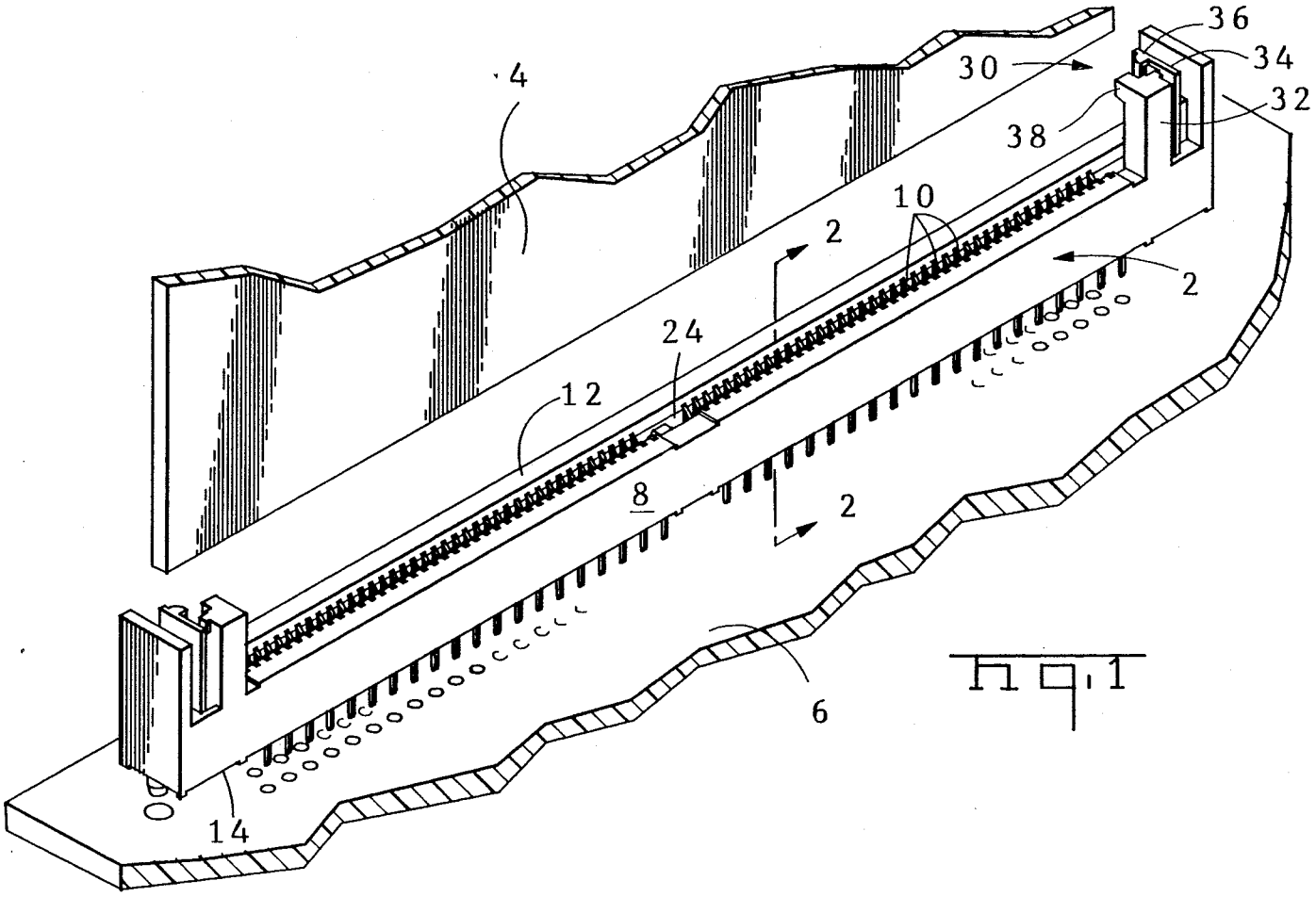
FIG. 1 is perspective view of the preferred embodiment of this invention suitable for mounting a circuit panel, such as a single inline memory module, at right angles to a printed circuit board.
Figure 2:
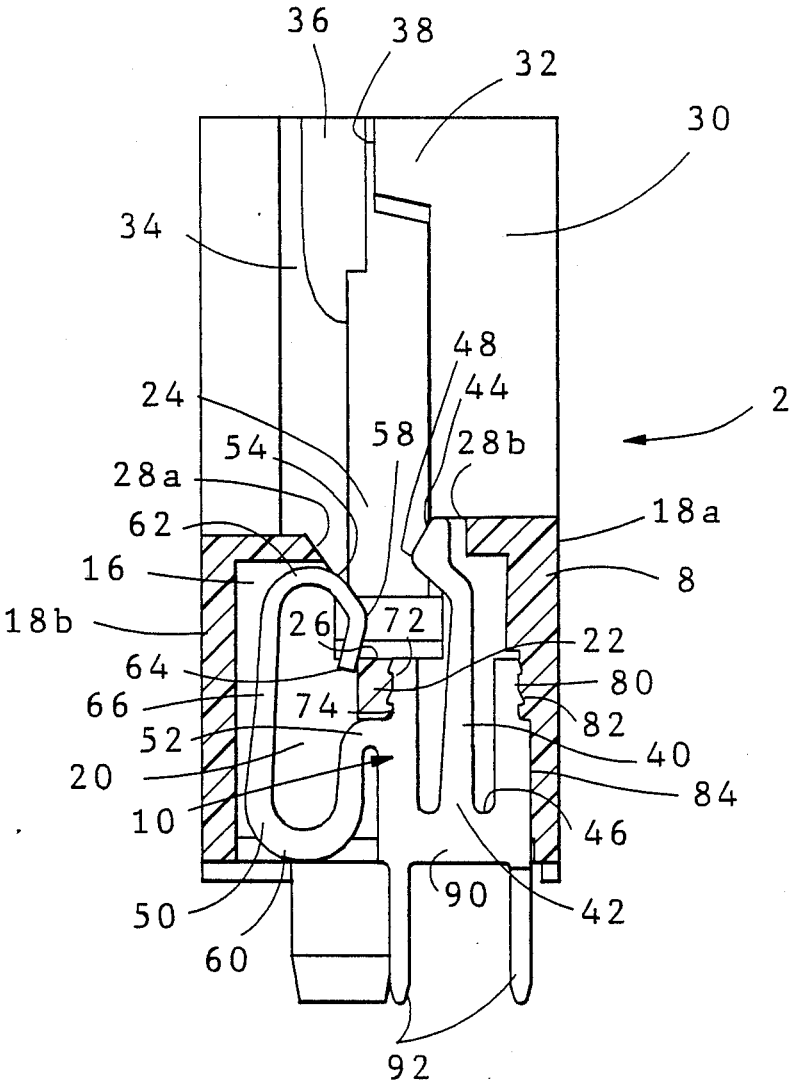
FIG. 2 is a sectional view taken along section lines 2—2 in FIG. 1, showing the configuration of one contact terminal.
Figure 1:
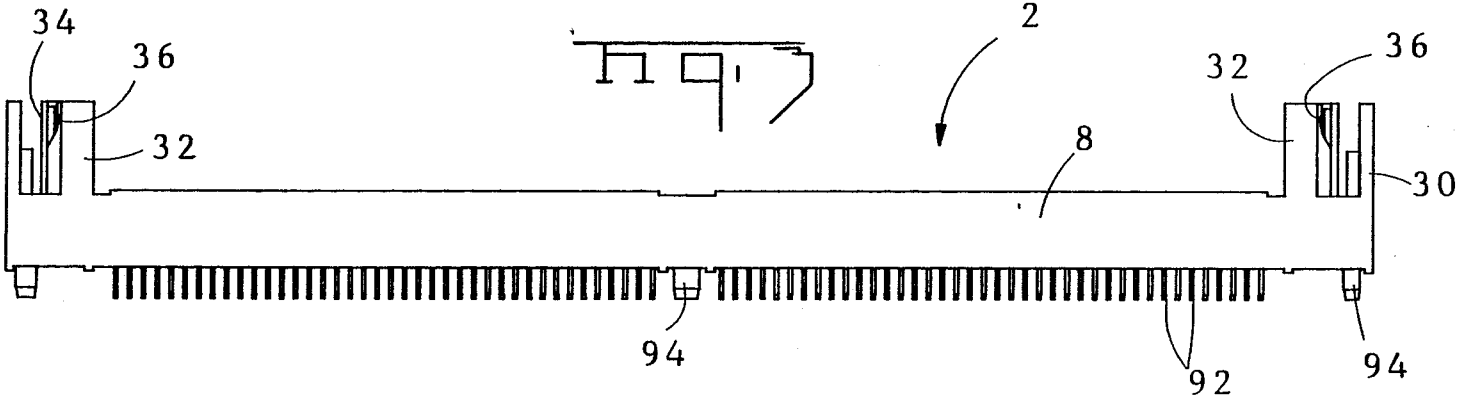
Figure 4:
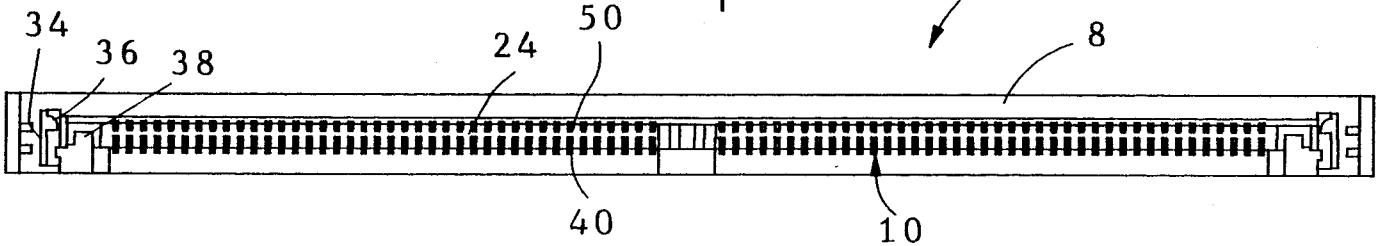
FIG. 4 is a top or plan view of the socket shown in FIG. 1 showing the panel receiving slot.
Figure 4:
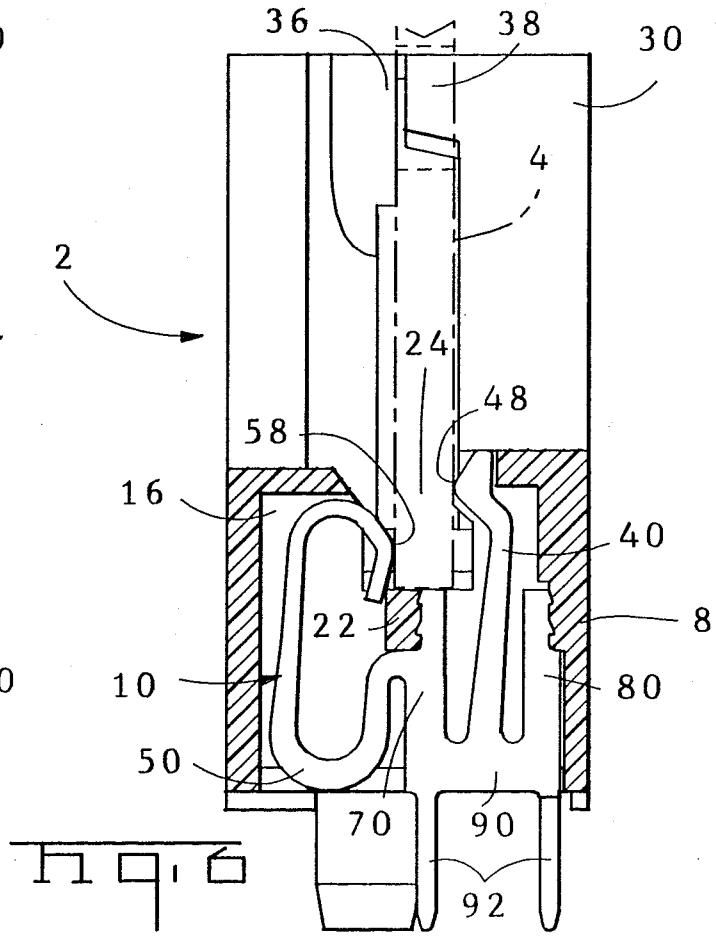

FIGS. 1 through 6 describe the preferred embodiment of this invention comprising a socket 2 including an insulative housing 8 in which a plurality of terminals 10 are located. Socket 2 can be mounted on printed circuit board 6 and a circuit panel 4, such as a single inline memory module can be mounted in socket 2. Contact terminals 10 are edge stamped from a blank. In the preferred embodiment these contact terminals can be fabricated from a conventional material such as a phosphor bronze. Preferably a tin lead plating would be employed. The housing 8 would be fabricated from a conventional material such as a glass reinforced liquid crystal polymer. The circuit panel 4 is inserted into the socket 2 at an angle and is then rotated to its final position, thus permitting a low insertion or zero insertion contact to be established with traces on either or both of the sides of the circuit panel 4.

The central portion of the insulative housing 8 has a mating face 12 and a rear face 14. A plurality of cavities 16 extend from the mating face to the rear face. Each cavity communicates with opposite sides of a panel receiving slot 24. Each cavity 16 also opens onto the rear face of the housing. Panel receiving slot 24 opens onto the mating face of the housing and is defined by opposite sides 28*a* and 28*b*. The lower surface 26 of the panel receiving slot 24 comprises the upper surface of a plurality of central ribs 22. A central rib 22 is located in each of the cavities 16. The cavities 16 are formed by a plurality of opposed sidewalls 20 which extend generally perpendicular to the panel receiving slot 24. Opposite endwalls 18*a* and 18*b* extend between sidewalls 20 in each cavity. The opposite end walls 18*a* and 18*b* form as a composite structure the side of the insulative housing 8 extending between the mating face 12 and the rear face 14. Alternatively, the outer sides of the insulative housing 8 can be said to comprise the opposite end walls of the cavities 16. Central ribs 22 extending between sidewalls 20 are spaced from the opposite end walls 18*a* and 18*b*. The central ribs 22 are also spaced from both the mating face 12 and the rear face 14 of the insulative housing 8.

Figure 5:
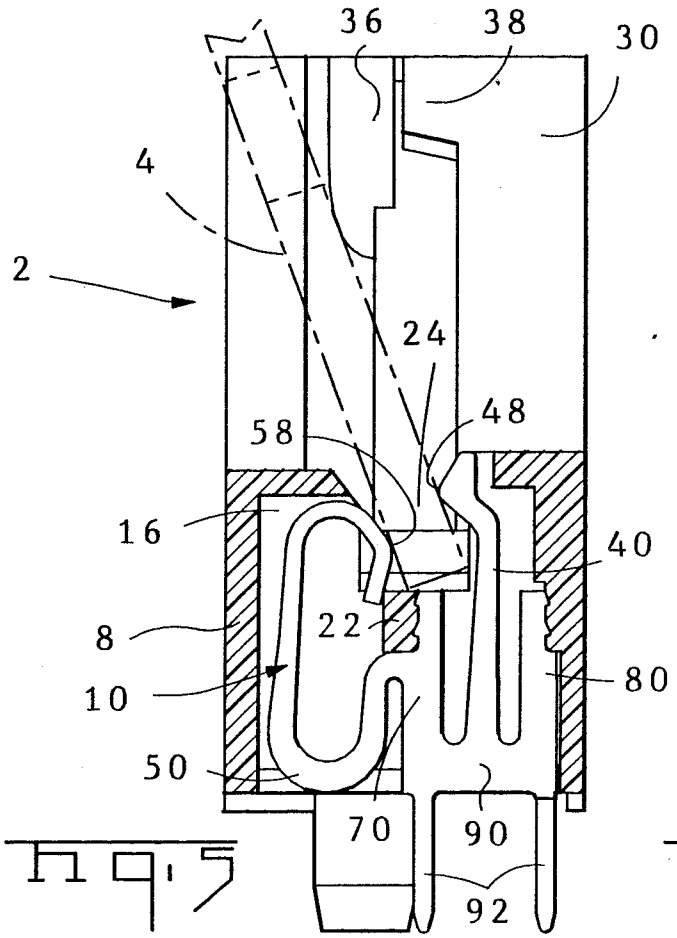
FIG. 5 is a view similar to FIG. 2 showing the manner in which a circuit panel, such as a single inline memory module, is first inserted into the housing.

The panel receiving slot 24 has a width sufficient to receive one edge of a circuit panel 4, such as a single inline memory module, at a first orientation and permit rotation of the circuit panel 4 to a second orientation. In the embodiment of FIGS. 1 through 6, the circuit panel 4 is inserted at an acute angle relative to the socket 2 and also relative to the printed circuit board 6 and is then rotated into a position generally perpendicular to the printed circuit board 6 as shown in FIGS. 5 and 6. When the circuit panel 4 is inserted at an angle, only a small insertion force, and perhaps no insertion force at all, will be required. Of course, since this invention is intended to be suitable for use with circuit panels 4 or single inline memory modules for which the thickness is not closely controlled, it is possible for a relatively thin printed circuit board to be inserted with no force whereas a slightly thicker circuit board could only be inserted on the application of a small insertion force prior to rotation to the final position.

As with other low insertion force sockets of this general type in which the circuit panel or single inline memory module 4 is rotated into a final position, the insulative housing 8 includes panel latch members 30 located at opposite ends of the panel receiving slot 24. These panel latch members are suitable for retaining the circuit panel 4 after rotation of the circuit panel. The panel latch members 30 each comprise a stationary arm 32 and a flexible arm 34. A camming surface 36 is located at the upper end of the flexible arm 34 so that upon engagement of the curved camming surfaces 36, by an edge of circuit panel 4, the flexible arm 34 will bend outwardly. A post 38 extends from the stationary arm 32 and in the preferred embodiment of this invention, this post 38 will be received within a suitable hole on the circuit panel 4 to provide appropriate registry. When the circuit panel 4 is shifted to the position shown in FIG. 6, the flexible arm will snap back and a shoulder at the back of the cam surface will hold the circuit panel 4 in place against any reaction forces applied to the circuit panel 4 by the contact terminals 10.

A single contact terminal 10 is positioned within each cavity 16 in the preferred embodiment of this invention. These contact terminals 10 are inserted through the rear of the housing 8. It should be noted that after insertion of contact terminals 10 through rear face 14 into cavities 16, a suitable cover (not shown) can be applied along the rear face of the housing if desirable to prevent contamination by solder, solder flux or other materials.

Each contact terminal 10 includes a first or cantilever spring 40 and a second or curved spring 50. The cantilever spring 40 extends from a root section 90 adjacent the rear face of the insulative housing. The curved spring 50 is located laterally adjacent the root section 90. The first and second springs 40 and 50 are tapered to provide suitable stress distribution. Cantilever spring 40 has a rear edge 46 and a mating edge 44. The fixed end 42 of the cantilever spring 40 is located at the point where the cantilever spring extends from the rear edge 46. The length of the cantilever spring is slightly less than the distance between the mating face 12 and the rear face 14 of the housing. A contact point 48 facing inwardly towards panel receiving slot 24 is located at the mating edge 44 of the cantilever spring 40 adjacent the mating face 12 of the housing 8.

The curved spring 50 has a curved spring fixed end 52 located intermediate the rear face and the mating face. The curved spring 50 extends initially from the curved beam fixed end 52 toward the rear face 14 of the housing. A curved section 60 of the curved spring 50 is located adjacent the rear of the housing and the curved spring 50 extends from curved section 60 toward the mating face of the housing. A relatively straight section 66 extends between first curved section 60 located at the rear of the housing and an additional curved section 62 located adjacent the mating face 12 of the housing. A contact point 58 is located on the inner edge of the curved spring 50 adjacent the panel receiving slot 24. The additional curved section 62 extends arcuately such that the mating edge 54 of the curved spring is forward of the contact point 58 thus the contact point 58 is located between the additional curved section and the free end 64 of the curved spring 50. In other words, the contact point 58 is located between the additional curved section 62 and the rear face 14 of the housing 8. Contact point 58 is adjacent the free end 64 and extends into the panel receiving slot 24.

Each of the contact terminals 10, inserted into cavities 16 through the rear of the housing 8, are firmly held in position within the cavity 16 by first and second terminal securing means in the form of first and second cantilever arms 70 and 80, each of which have teeth or barbs 72 and 82 located adjacent their inner ends on outer edges 74 and 84. The teeth or barbs 72 and 82 are engagable with the insulative housing 8 to hold the terminals 10 in position. Both of the cantilever arms 70 and 80 extends from the root section 90 of the terminal and each is inwardly deflectable.

The first cantilever arm or first terminal securing means 70 extends between the cantilever spring 40 and the curved spring 50. The teeth 72 on the first cantilever arm 70 engage one side of the central rib 22 between the cantilever spring 40 and the curved spring 50. Cantilever arms 70 and 80 and the teeth or barbs located thereon comprise first and second securing means for securing each contact terminal 10 to the insulative housing 8 when the contact terminal 10 is inserted into the housing 8 from the rear. First and second cantilever arms 70 and 80 extend from the root section 90 on opposite sides of the cantilever spring 40. The teeth 72 and 82 on the cantilever arms 70 and 80 are located on the ends thereof between the mating edge of each terminal and the rear edge of each terminal.

The second curved spring 50 has a fixed end 52 which is located on the cantilever arm 70 located between the cantilever spring 40 and the curved spring 50. The curved spring 50 is then substantially C-shaped between this fixed end 52 and the free end 64. The length of the curved spring is slightly less than twice the distance between the mating face and the rear face of the insulative housing 8. Each of the first and second springs 40, 50 extend beyond the first and second terminal securing cantilever arm 70 and 80 toward the mating face of the housing 8. First and second springs 40 and 50 are thus in position to engage opposite sides of a circuit panel 4 upon insertion therebetween at the mating edge of the springs of the contact terminal 10. In the preferred embodiment of this invention the cantilever spring 40 extends beyond the curved spring 50 at the mating edge. With the cantilever spring 40 on one side of the panel receiving slot 24 and the curved spring 50 on the other side of the slot 24, the springs are in position such that rotation of the circuit panel in the slot 24 imparts deflection to both the cantilever spring 40 and the curved spring 50 since the contact points 48 and 58 are moved away from each other as the circuit panel 4 is moved into the position shown in FIG. 6.

Although the upper surface of the central rib 22 comprises a portion of the lower surface of the panel receiving slot 24, it should be noted that the contact point 58 extends inwardly beyond the edge of the central rib 22. It follows, therefore, that upon insertion of the contact terminals through the rear of the insulative housing 4 and into respective cavities, the curved spring 50 is deflected outwardly during insertion. After the contact point 58 and the additional curved section 62 passes the central rib 22, the curved spring remains in a preloaded state with the contact point 58 extending into the panel receiving slot 24. The free end 64 is adjacent the terminal securing means of the cantilever arm 70 extending between the cantilever spring 40 and the curved spring 50. The free end 64 of curved spring 50 is also adjacent to the central rib 22 and is deflected upward by engagement of the inner edge of the curved spring 50 with the central rib 22 when the contact terminal 10 is properly positioned within a cavity 16. The preload condition of the curved spring 50 allows the spring rate of the beam to be lower, thus reducing the range of normal force generated from a thin circuit panel or a thick circuit panel. Additionally, deflection of the two active beams 40 and 50 further reduces the effective spring rate and makes variations in board thickness less critical.

In the preferred embodiment of this invention, the socket 2 is positioned on a printed circuit board 6. Electrical contact with traces on the printed circuit board can be established by conventional means. In the preferred embodiment of this invention, through hole pins 92 comprising printed circuit board contact means extend from the rear most edge of terminals 10 beyond the bottom surface of the insulative housing 8. These pins 92 are suitable for insertion into holes on the printed circuit board and can be soldered thereto. Mechanical hold down is provided by a means of posts 94 extending from the bottom surface of the housing.

Figure 7:
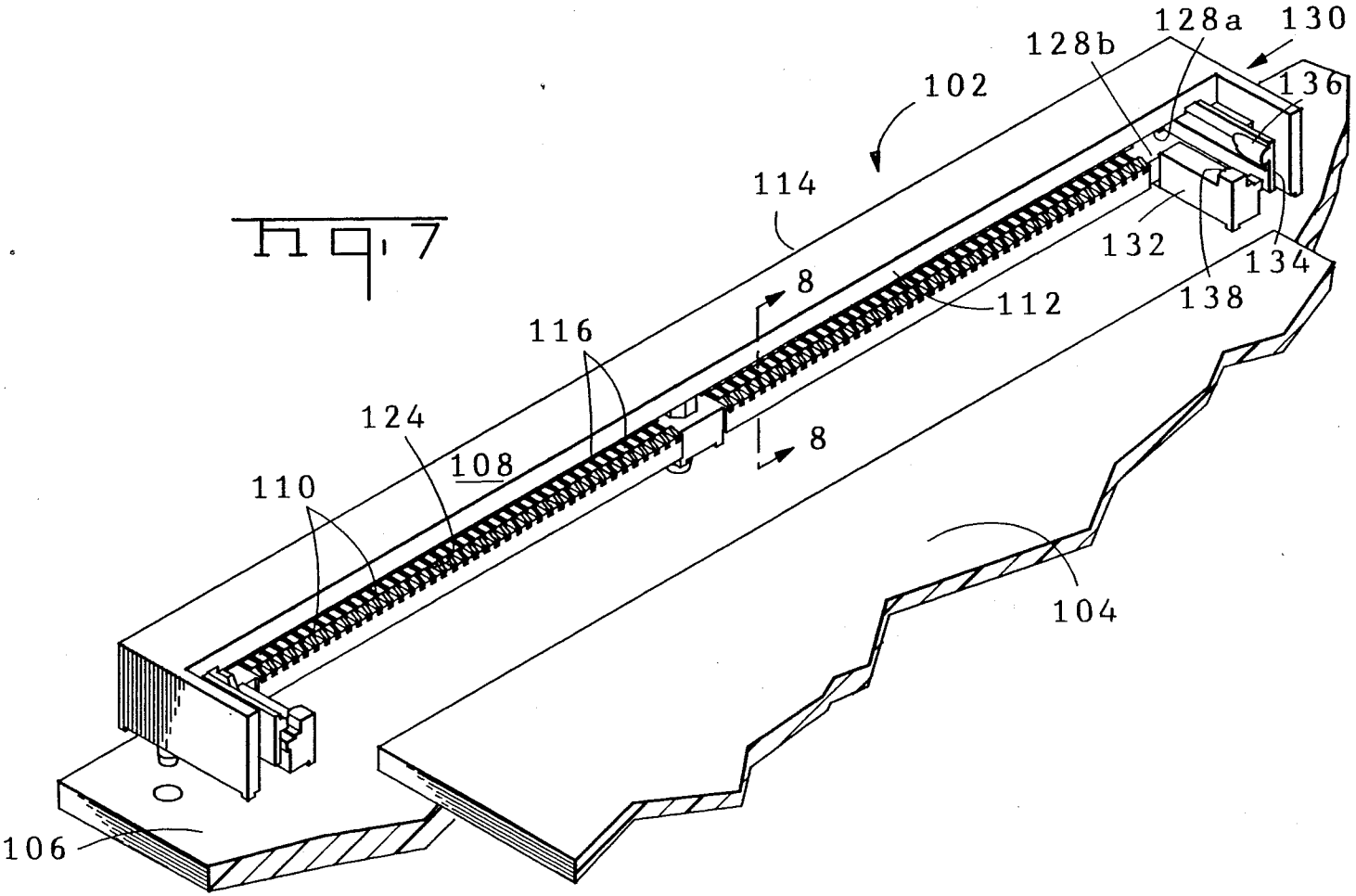
FIG. 7 is a view of an alternate embodiment of this invention suitable for mounting a circuit panel or single inline memory module parallel to a printed circuit board on which the socket is mounted.
Figure 1:
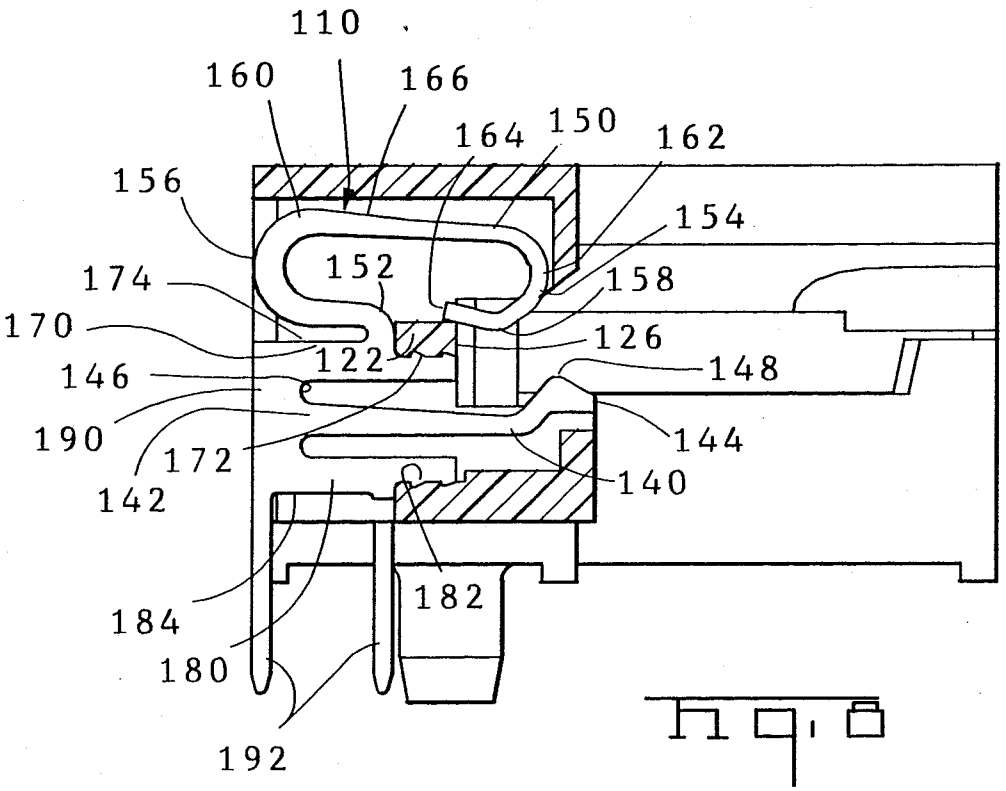
Figure 7:
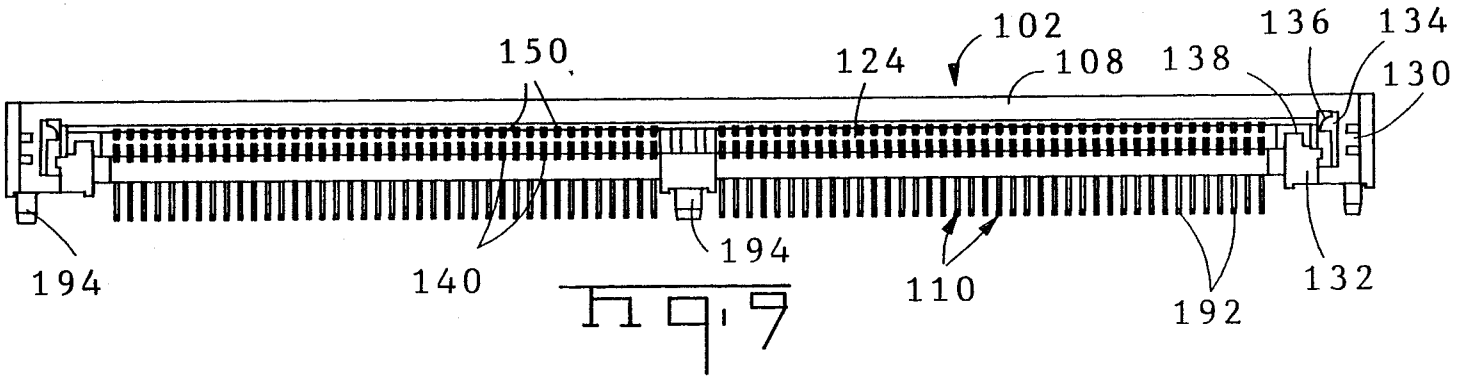
Figure 10:
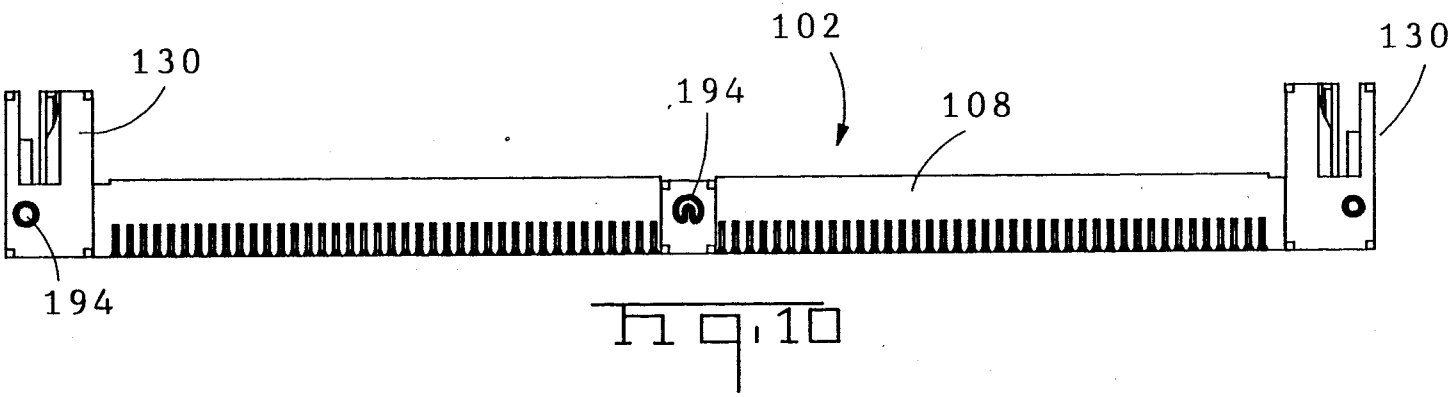
FIG. 10 is a view of the bottom surface of the socket shown in FIG. 7.

The principal difference between the socket 102 shown in FIGS. 7 through 10 and the socket 2 shown in FIGS. 1 through 6 is the relative orientation of the circuit panel or single inline memory module 104 relative to the printed circuit board 106. As shown in FIG. 7, the socket 102 is configured such that the circuit panel 104 extends parallel to the printed circuit board 106 when properly in engagement with the socket 102. In this embodiment the printed circuit board contact pins 192 extend transversely relative to the cantilever springs 140 so that the socket can be mounted on the printed circuit board with the slot 124 extending parallel to the board and with the circuit panel 104 also extending parallel to the printed circuit board 106. In the embodiment of FIGS. 7 through 10 the pins 192 extend from an outer edge of the cantilever arm 180. In this configuration the cantilever beam 140 is located on the lower side of the slot 124 and the curved spring 150 is located on the upper side of the slot. Note that the rearmost edge of the contact terminal 110 does not extend beyond the rear of the insulative housing 108. Since the other elements of the socket 102 correspond to similar elements of socket 2, each of the reference numerals 102 through 194 correspond to elements identified by similar reference numerals from 2 through 94. For this reason a more extensive discussion of the embodiment of FIGS. 7 through 10 is believed to be unnecessary and the appropriate comments relevant to the socket 2 are applicable to the second embodiment of FIGS. 7 through 10.

Figure 11:
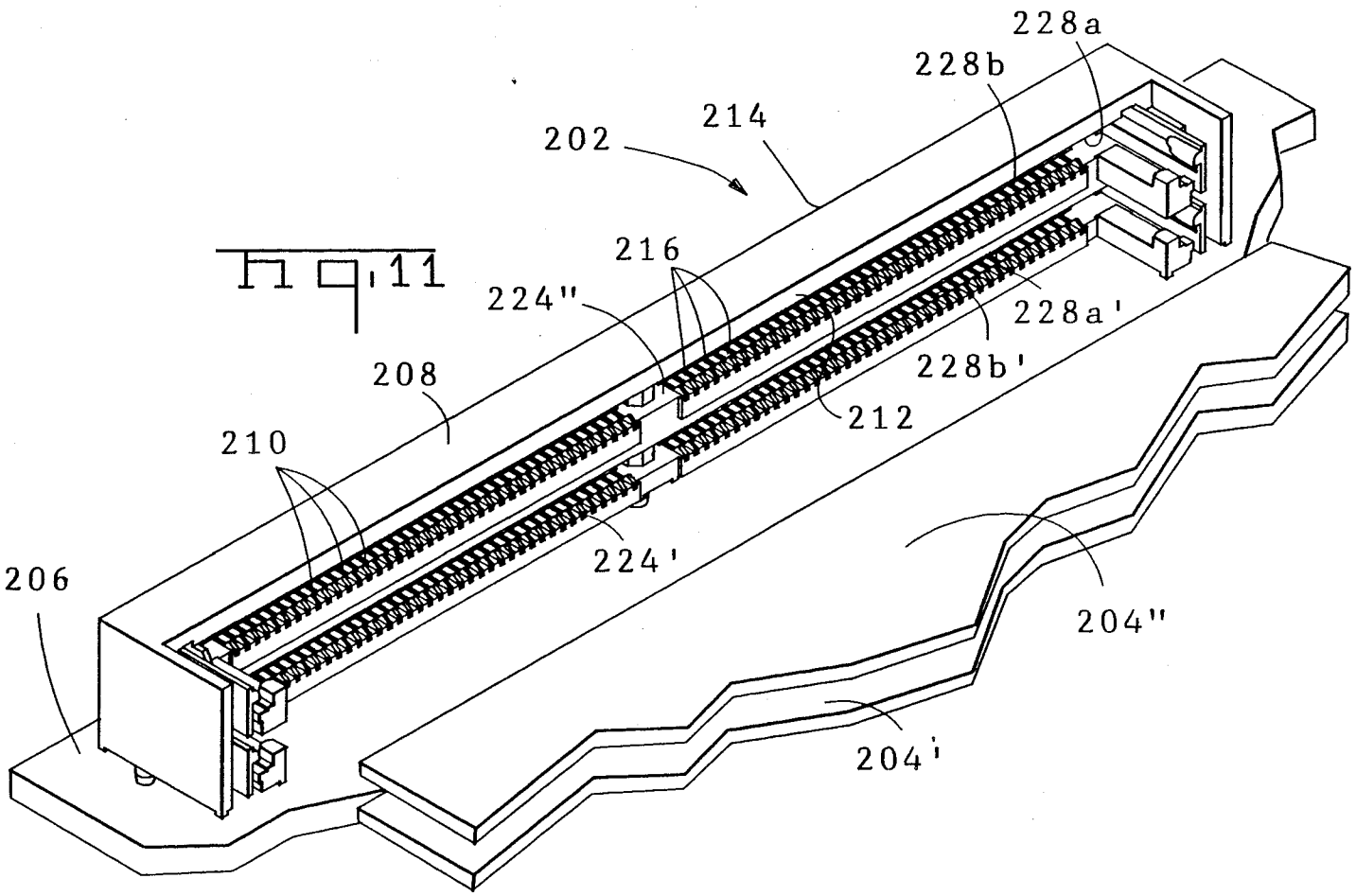
FIG. 11 is a perspective view of another alternate embodiment of this invention. This socket and the terminals used therein are intended for establishing electrical connection between two circuit panels, or single inline memory modules, both positioned parallel to the printed circuit board on which the socket can be mounted.
Figure 12:
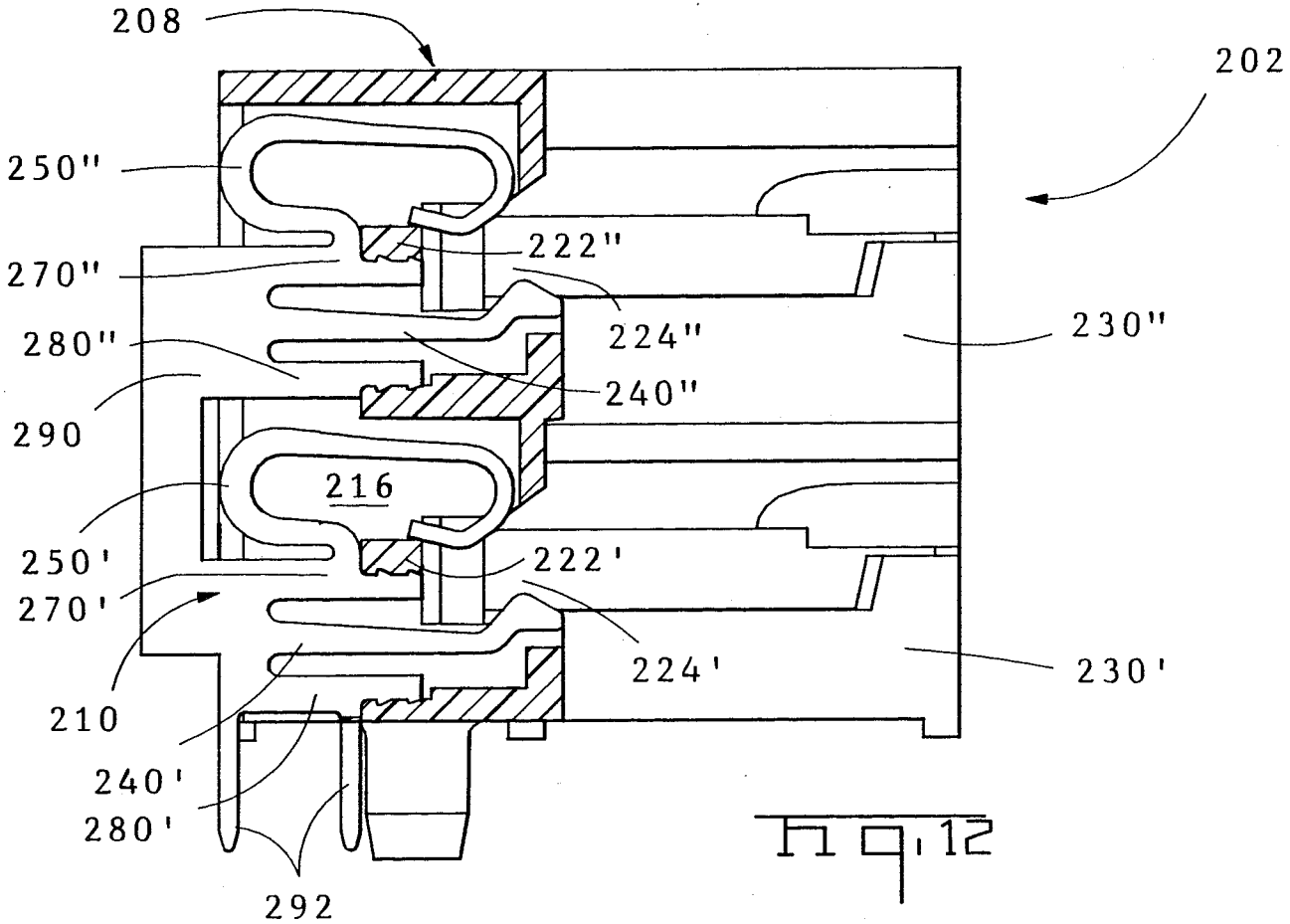
FIG. 12 is a section view of the embodiment shown in FIG. 11.
Figure 17:
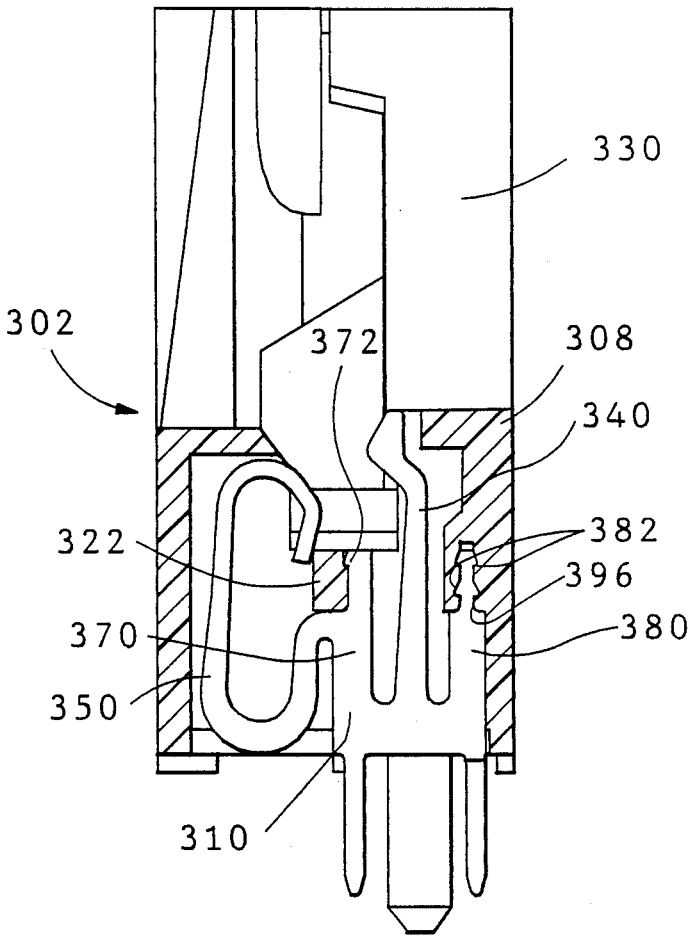

Another alternate embodiment is shown in FIGS. 11 and 12. This socket 202 comprises a stacked parallel version in which two circuit panels 204' and 204" can be inserted into two circuit panel slots 224' and 224". Note that a single contact terminal 210 having two pairs of cantilever springs 240', 240" and curved springs 250' and 250" are positioned on the same contact terminal. Note that this configuration would insure that corresponding traces on one circuit panel 204' would be electrically commoned to corresponding traces on circuit panel 204". This configuration could be employed to interconnect two circuit panels 204' and 204", or two single inline memory modules even if no interconnection is made to the printed circuit board. Alternatively, electrical interconnection can be established between the printed circuit board 206 and each of the circuit panels 204' and 204". Corresponding structures of the embodiment of FIGS. 11 through 12 otherwise have the same function as the structures of the parallel embodiment of FIGS. 7 through 10 as well as the preferred embodiment of FIGS. 1 through 6. Therefore, the same reference numeral convention is employed with respect to the embodiment of FIGS. 11 and 12 as with the embodiment of FIGS. 7 through 10. In other words, panel receiving slots 224 correspond to panels receiving slots 124 and indeed correspond to panel receiving slots 24 of the preferred embodiment.

One of ordinary skill in the art will appreciate the additional embodiments employing the essential elements of the claimed invention could be fabricated. For example, a dual row vertical socket having the same relationship to the embodiment of FIGS. 1 through 6 as the embodiment of FIGS. 11 and 12 has to the embodiment 7 through 10 could be employed. Alternatively, different printed circuit board contact means could be employed, for example, surface mount contacts might be used. Other alternate configurations might employ the contact point of the curved spring ahead of the contact point of the cantilever spring. Alternatively, the outer cantilever arm might be secured more closely adjacent the rear of the housing than the terminal securing point of the cantilever arm located between the cantilever spring and the curved spring. The socket 302 shown in FIG. 13 differs from the socket 2 shown in FIGS. 1–6 in that the contact terminal 310 has terminal securing means on arms 370 and 380 which differ from those in the embodiment of FIGS. 1-6. A clip section 372 adjacent the end of arm 370 snaps over the central rib 322. Teeth 382 are located on opposite edges of the end of arm 380 and are received within bore 396 facing the rear of the housing 308. These additional modifications are not intended to represent a complete compilation of all modifications which might be apparent to one of ordinary skill in the art after review of this specification. Indeed, these exemplary modification are only representative of numerous other modifications which might occur to one of ordinary skill in the art but which would still be encompassed within the following claims.

We claim:

1. A socket for establishing electrical connections with a circuit panel, comprising:

an insulative housing having a mating face and a rear face;

a plurality of cavities extending from the rear face to the mating face;

a contact terminal in each cavity comprising first and second springs exposed adjacent the mating face of the housing for establishing electrical contact with opposite sides of the circuit panel and first and second terminal securing means engagable with the housing for securing each terminal in the housing, the first terminal securing means located between the first and second springs which extend beyond the first and second securing means toward the mating face of the housing, so that when a circuit panel is inserted between the first and second springs, the first terminal securing means is located below the circuit panel.

2. The socket of claim 1 wherein the first and second securing means comprise means for securing each contact terminal to the insulative housing when said contact terminal is inserted into the housing from the rear of the housing.

3. The socket of claim 2 wherein a central rib extends through each cavity, the first terminal securing means engaging the central rib.

4. The socket of claim 3 wherein each cavity is defined by opposite endwalls extending between opposite sidewalls, the central rib extending between opposite sidewalls and being spaced from opposite endwalls, the second terminal securing means engaging an endwall.

5. The socket of claim 2 wherein each contact terminal includes a root section adjacent the rear face of the insulative housing, the first and second terminal securing means and the first spring extending from the root section.

6. The socket of claim 5 wherein the first and second terminal securing means comprise cantilever arms extending from the root section toward the mating face, each cantilever arm having teeth on outer edges thereof engagable with the insulative housing.

7. The socket of claim 6 wherein the first spring comprises a cantilever beam extending from the root section.

8. The socket of claim 1 wherein the second spring comprises a curved beam having a fixed end intermediate the rear face and the mating face, the curved beam extending initially from the curved beam fixed end toward the rear face and then from a curved section toward the mating face.

9. The socket of claim 8 wherein the first spring comprises a cantilever beam having a fixed end adjacent the rear face and extending toward the mating face.

10. The socket of claim 8 wherein the second spring has an additional curved section adjacent the mating face and a contact point between the curved section and the free end of the second spring, the contact point being located between the additional curved section and the rear face of the housing.

11. A contact terminal for use in a socket for establishing electrical contact to a circuit panel comprising: an edge stampled blank and including first and second springs disposed on opposite sides of a central slot, the first spring comprising a cantilever spring fixed adjacent a rear edge of the contact terminal and extending toward a mating edge thereof, the second spring comprising a curved spring fixed intermediate the rear edge and the mating edge, the curved spring extending initially toward the rear edge and then toward the mating edge so that the length of the curved spring is increased, whereby the first and second springs engage opposite sides of the circuit panel upon insertion therebetween on the mating edge of the contact terminal.

12. The contact terminal of claim 11 wherein the cantilever spring extends from a root section at the rear edge of the terminal.

13. The contact terminal of claim 12 wherein the curved spring is located laterally adjacent the root section.

14. The contact terminal of claim 13 wherein first and second cantilever arms extend from the root section on opposite sides of the cantilever spring.

15. The contact terminal of claim 14 wherein the curved spring extends from the second cantilever arm located between the cantilever spring and the curved spring.

16. The contact terminal of claim 15 wherein the first and second cantilever arms have terminal securing means located on the ends thereof between the mating edge of the contact terminal and the rear edge.

17. The contact terminal of claim 16 wherein the curved spring is substantially C-shaped, the free end thereof being adjacent the terminal securing means of the second cantilever arm.

18. The contact terminal of claim 16 wherein the terminal securing means comprise barbs on the outwardly facing edges of the first and second cantilever arms.

19. The contact terminal of claim 11 wherein the cantilever spring extends beyond the curved spring on the mating edge.

20. The contact terminal of claim 11 wherein the curved spring and the cantilever spring are each tapered.

21. A socket for establishing a low insertion force contact with opposite sides of a circuit panel, comprising:

an insulative housing having a mating face and a rear face;

a panel receiving slot on the mating face of the housing having a width sufficient to receive one edge the circuit panel at a first orientation and permit rotation of the circuit panel to a second orientation;

a plurality of cavities communicating with the slot, each cavity communicating between opposite sides of the slot;

contact terminals in the cavities, each terminal having a cantilever spring on one side of the slot and a curved spring on the opposite side of the slot, the curved spring being fixed intermediate a rear edge and a mating edge of the terminal and extending initially toward a rear edge of the terminal and then toward a forward edge of the terminal so that the length of the curved spring is increased, rotation of the circuit panel in the slot imparting deflection to the cantilever spring and the curved spring.

22. The socket of claim 21 wherein the cantilever spring has a cantilever spring fixed end adjacent the rear edge of the terminal and the curved spring has a curved spring fixed end located between the cantilever spring fixed end and the mating edge of the contact terminal.

23. The socket of claim 22 wherein the length of the cantilever spring is slightly less than the distance between the mating face and the rear face and the length of the curved spring is slightly less than twice the distance between the mating face and the rear face.

24. The socket of claim 21 wherein the curved spring is substantially C-shaped and has a contact point adjacent a free end positioned within the slot.

25. The socket of claim 21 wherein each cavity opens onto the rear face of the housing, the terminals being insertable through the rear face.

26. The socket of claim 25 wherein a central rib is located in each cavity, one side of the central rib comprising the lower surface of the slot.

27. The socket of claim 26 wherein the contact terminal has a terminal securing means located between the curved spring and the cantilever spring, the terminal securing means therebetween engaging the central rib.

28. The socket of claim 21 wherein the housing has panel latch means for retaining the circuit panel after rotation of the circuit panel and deflection of the cantilever springs and the curved springs.

29. The socket of claim 21 wherein the contact terminals have board contact means extending transversely relative to the cantilever springs, so that the socket can be mounted on a printed circuit board with the slot extending parallel to the board, the circuit panel being insertable into the slot at an angle relative to the board and rotatable into a position parallel with the board.

30. The socket of claim 29 wherein the socket has two slots, one above the other and each cavity communicates with both slots, each contact terminal having two pairs of curved springs and cantilever springs to electrically interconnect circuit panels in each slot with the printed circuit board.

31. A socket for establishing electrical connection with a circuit panel, comprising:

an insulative housing having a mating face and a rear face;

a plurality of cavities extending from the rear face to the mating face, each cavity having a central rib extending between opposite sidewalls of each cavity; and a contact terminal in each cavity having opposed springs, one spring comprising a C-shaped curved spring engaging the central rib adjacent a free end of the C-shaped curved spring and being outwardly biased thereby in a preloaded condition.

32. The socket of claim 31 wherein each terminal is attached to the corresponding central rib in each cavity.

33. A contact terminal for use in a socket for establishing electrical interconnection between two single inline memory modules comprising an one piece edge stamped blank and including two pairs of first and second springs, each first spring comprising a cantilever spring fixed adjacent a rear edge of the contact terminal and extending toward a mating edge thereof, the curved spring being spaced from the rear edge over its entire length, each second spring comprising a curved spring fixed intermediate the rear edge and the mating edge, the curved spring extending initially toward the rear edge and then toward the mating edge whereby the first and second springs in each pair engage opposite sides of one single inline memory module upon insertion therebetween on the mating edge of the contact terminal.

* * * * *

UNITED STATES PATENT OFFICE

CERTIFICATE OF CORRECTION

Patent No. 4,946,403 Dated August 7, 1990

Inventor(s) Roger Thrush, Timothy Billman and Bob McHugh

It is certified that error appears in the above-identified patent and that said Letters Patent is hereby corrected as shown below:

Claim 1, Column 8, Line 4 - insert --being-- after the word "means".

Claim 11, Column 8, Line 54 - the word "stampled" should be --stamped--.

Signed and Sealed this

Eleventh Day of February, 1992

*Attest:*

HARRY F. MANBECK, JR.

*Attesting Officer*

*Commissioner of Patents and Trademarks*